US007287343B2

(12) United States Patent
Healy

(10) Patent No.: US 7,287,343 B2
(45) Date of Patent: Oct. 30, 2007

(54) FOOTWEAR WITH ARTICULATING OUTSOLE LUGS

(75) Inventor: John Healy, Madbury, NH (US)

(73) Assignee: The Timberland Company, Stratham, NH (US)

( * ) Notice: Subject to any disclaimer, the term of this patent is extended or adjusted under 35 U.S.C. 154(b) by 303 days.

(21) Appl. No.: 10/951,007

(22) Filed: Sep. 27, 2004

(65) Prior Publication Data

US 2005/0081405 A1 Apr. 21, 2005

Related U.S. Application Data

(60) Provisional application No. 60/506,270, filed on Sep. 25, 2003.

(51) Int. Cl.
*A43C 15/00* (2006.01)
*A43B 5/00* (2006.01)

(52) U.S. Cl. ..... 36/67 R; 36/59 R; 36/134; D2/906; D2/908

(58) Field of Classification Search ..... 36/67 R, 36/67 D, 59 R, 134, 114; D2/906, 908, 951, D2/959, 962
See application file for complete search history.

(56) References Cited

U.S. PATENT DOCUMENTS

| | | | | |
|---|---|---|---|---|
| 1,011,110 | A * | 12/1911 | Brown | |
| 3,043,025 | A * | 7/1962 | Semon | 36/59 R |
| 3,481,332 | A * | 12/1969 | Arnold | 602/10 |
| 4,366,632 | A * | 1/1983 | Bente | 36/67 D |
| 4,375,728 | A * | 3/1983 | Dassler | 36/32 R |
| 4,404,759 | A | 9/1983 | Dassler | |
| 4,769,931 | A * | 9/1988 | Morrow et al. | 36/134 |
| 5,313,718 | A | 5/1994 | McMahon et al. | |
| 5,505,012 | A * | 4/1996 | Walker et al. | 36/134 |
| 5,743,029 | A * | 4/1998 | Walker et al. | 36/134 |
| 5,791,071 | A * | 8/1998 | Rosdail | 36/134 |
| 5,901,472 | A * | 5/1999 | Adam | 36/134 |
| D418,968 | S * | 1/2000 | Parker | D2/962 |
| 6,052,923 | A * | 4/2000 | McMullin | 36/127 |
| D424,793 | S * | 5/2000 | Lubart | D2/957 |
| D432,767 | S * | 10/2000 | Fogg | D2/957 |
| 6,434,860 | B1 * | 8/2002 | Turos | 36/134 |
| 6,817,117 | B1 * | 11/2004 | Campbell | 36/127 |
| 2002/0078598 | A1 * | 6/2002 | Bell | 36/59 R |
| 2003/0131502 | A1 * | 7/2003 | Terashima | 36/127 |

FOREIGN PATENT DOCUMENTS

| | | |
|---|---|---|
| DE | 17 50 346 U | 8/1957 |
| DE | 30 35 706 A | 6/1982 |
| DE | 298 18 243 U | 1/1999 |
| FR | 2 611 450 A | 9/1988 |
| FR | 2 726 978 A | 5/1996 |

* cited by examiner

*Primary Examiner*—Marie Patterson
(74) *Attorney, Agent, or Firm*—Lerner, David, Littenberg, Krumholz & Mentlik, LLP

(57) ABSTRACT

An improved shoe outsole, and a shoe incorporating the outsole, having improved traction are provided. The outsole contains articulated lugs of various shapes extending downward from the base of the outsole and adapted for contacting the ground and enhancing traction.

14 Claims, 9 Drawing Sheets

FOOTWEAR WITH ARTICULATING OUTSOLE LUGS

CROSS-REFERENCE TO RELATED APPLICATION

This application claims the benefit of Provisional Patent Application No. 60/506,270, filed Sep. 25, 2003, which is incorporated herein by reference in its entirety.

BACKGROUND OF THE INVENTION

The structure of a contemporary shoe includes a bottom component or outsole that is designed to interface with the ground, and an upper component or upper that is designed to interface with the foot and the outsole. Each of these components is designed with specific characteristics for enhancing the performance of that particular component and the shoe as a whole.

The shoe outsole is designed to provide a stable platform for the foot to rest on, for protection against the ground and obstacles on the ground, and to provide traction between the shoe and the surface to enable the wearer to propel, brake, and change direction. In addition to mechanical performance characteristics, the shoe outsole must also demonstrate durability and have particular resistance to wearing abrasion in order to provide the user with a reasonable outsole life.

One important characteristic of a shoe outsole is the shoe-to-surface contact and the friction that develops between these two surfaces. The existence of friction between the shoe and the ground effectively enables the wearer to move or propel himself or herself over the ground. When the shear loading of a shoe exceeds the available friction (traction) between the shoe and surface, the shoe slips over the surface. Thus, traction is important as the shoe contacts the ground, and the sheer forces increase as normal (i.e. perpendicular) loading increases. This is especially true for shoe types which place a premium on traction, such as hiking shoes, running shoes and work boots.

Consequently, and in view of all of these demands on modern footwear, shoe designers are continually looking for opportunities to increase the traction and efficiency of shoes by incorporating novel features into shoe tread materials and designs.

It will therefore be readily appreciated that there remains a need for a shoe that adjusts to uneven terrain in response to the normal loading of the shoe on rough or uneven surfaces.

SUMMARY OF THE INVENTION

An improved shoe outsole design provides for increased traction by presenting a greater surface area over rough terrain and adding traction mechanisms during the loading of the shoe and contact with the ground. The shoe advantageously adjusts to uneven terrain as a natural response to loading the shoe on uneven surfaces. As a result, ground contact may be increased under certain use conditions, in particular when traction may be most desired.

In one embodiment of the invention, one or more lugs forming part of a shoe outsole as described herein are adapted to articulate to provide improved traction. The lugs may contain a hinge joint that allows the lugs to change orientation once the outsole is loaded with a force, such as the bearing weight of the wearer. In one aspect of the invention, the hinge may be in the form of a mechanical elbow joint. In another aspect of the invention, the hinge may be molded into the lug. In a further aspect, the hinge may be formed from a separate material that has lower stiffness than the material forming the top of the lug. The lower stiffness may permit the lug to elongate and/or bend at the point of the decreased material stiffness. The lugs of the invention may be predisposed to articulate in a specific direction, either rearward, forward or to the side as desired.

The lugs can be evenly or symmetrically distributed over the shoe outsole tread if desired. Alternatively, the lugs can be unevenly distributed by being placed at strategic areas on the shoe outsole to improve traction at the point of maximum shoe to ground contact. Such strategic areas can be located on the heel or toe portion of the outsole, and include, for example, the outer edges of the toe portion of the shoe outsole. The lugs can also be interspersed with other, more conventional shoe tread elements for a mix of tread performance characteristics.

The lugs may be in the shape of uniformly shaped cylindrical or angular projections extending from the base of the outsole. Alternatively, the lugs can be splayed or branched at the extended end portions thereof, and optionally may contain gripping elements for improved traction. The lugs may also contain side or circumferential projections, filaments, ridges, grooves, spikes, or the like to maximize the outsole/ground traction of the shoe.

The foregoing and other objects and advantages of the invention will be appreciated more fully from the following further description thereof and from the accompanying drawings.

DESCRIPTION OF THE PREFERRED EMBODIMENTS

Figure 1A:
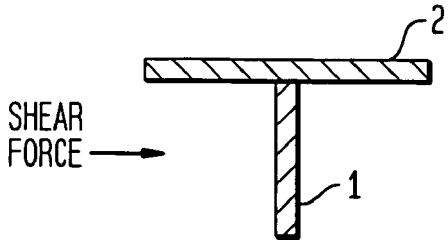
FIGS. 1A and 1B are side sectional views of a single lug in both an unloaded and undeformed condition (FIG. 1A), and the same lug subjected to loading and deformation (FIG. 1B).

A shoe as provided herein has an outsole with articulating outsole lugs that adjust to the terrain and increase traction during loading of the shoe and the contact of the shoe with the ground. The outsole lugs of the invention are designed to deform or articulate when contacting the ground to adapt to normal loading of the shoe as a result of supporting the wearer. The articulation and deformation of the lugs increase the surface area contact between the shoe and the ground surface.

To improve traction and shoe performance, the texture and surface area of the outsole lugs can be enhanced by including elements of various geometric configuration placed on the side surfaces of the lugs. The lateral or side surfaces of the lugs may lie perpendicular to the ground when the shoe is in the unloaded state. i.e. not being worn by a user. When normal forces are present on the shoe while being worn, the articulation and/or deformation of the lugs may bring the side surfaces of the lugs in contact with the ground, allowing the texture and shape of the lug to interlock with the ground and thereby present a greater surface area for traction, or present different geometric configurations for enhancing the interlock with the ground.

As used herein, the term "lug" is intended to denote an outwardly projecting element secured to the base of the shoe outsole. The lug can have any desired shape or configuration so long as it serves the purpose of increasing traction of the shoe while in contact with the ground. Typical lug shapes include cylinders, projections of various angular shapes (square, triangular and rectangular, for instance). The base portion of the lug is designed to be secured to the base of the outsole, leaving the lug tip and side portions available to contact the ground. The lug tip may be solid, split or splayed, and the side portions of the lug may contain projections of various types and designs, such as grooves, filaments, ridges, spikes, and the like, for improved gripping and traction.

The lugs can be evenly or symmetrically distributed over the base of the shoe outsole if desired. Alternatively, the lugs can be unevenly distributed by being placed at strategic areas on the shoe outsole to improve traction at the point of maximum shoe to ground contact. Such strategic areas can be located on the heel or toe portion of the outsole, and include, for example, the outer edges of the heel and/or toe portion of the shoe outsole. The lugs can also be interspersed with other, more conventional shoe tread elements for a mix of traction and performance characteristics.

More generally, the lugs or other portions of the sole outsole can change shape during the loading cycle of the gait, i.e. when the wearer exerts pressure on the shoe as a result of ground contact. The shape change of the outsole can either increase the overall surface area contact, or allow another geometrical design or material type to come in contact with the ground to enhance mechanical interlock.

Also as used herein, the term "shoe" is intended to mean any type of footwear where improved traction is desirable. Typical footwear within the scope of this invention includes running shoes, walking shoes, work boots, hiking shoes and boots, and trail shoes. The shoe outsole is that portion of the sole that contact the ground and interfaces with the shoe upper. Typically, at least the bottom portion of the shoe outsole is constructed of a molded plastic or rubber material.

The lugs can also be fabricated from any suitable material used for molding such shapes, such as rubber or plastic. Preferred plastic materials include polyvinylchloride (PVC), polyurethane (PU), thermoplastic urethane (TPU) and ethylvinylacetate (EVA).

The articulation of the outsole lugs can occur under a variety of situations and through numerous lug designs. For example, the lugs may be designed to deform and bend when loaded, allowing the vertical wall of the lug to interact with the ground surface. In certain embodiments the lugs may be configured to articulate in only one direction. For instance, lugs in the toe area of the outsole normally come in contact with the ground surface during the propulsion phase of the gait. Therefore, forcing the lugs to articulate towards the toe places the lug into a position to help with the propulsion at the toe. Conversely, the heel may be used more aggressively while braking or traveling over descending terrain. Lugs in the heel may be similarly configured to provide improved braking traction under these conditions.

The lugs can also provide a texture, geometry, or other mechanism for increasing traction by providing elements or designs on the side profile of the lug. This side profile will come into contact with the surface when the lug is loaded and articulates to that side.

Lugs can be constructed with multi-level shelves or grooves molded into the bottom surface of the lug. In such an embodiment, loaded deformation of the portion of the lug closest to the ground will allow other levels of the lug to come in contact with the ground to thereby increase traction by increasing surface area contact.

Figure 1B:
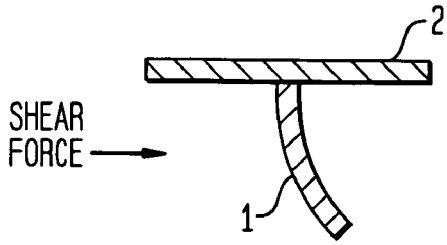
Figure 2A:
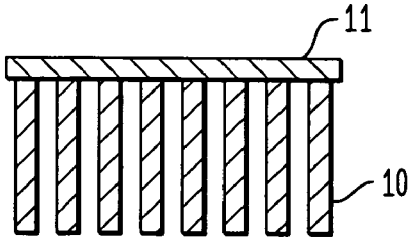
FIGS. 2A and 2B are side sectional views of a shoe outsole showing multiple outsole lugs in the form of small round projections extending from the outsole base.
Figure 2B:
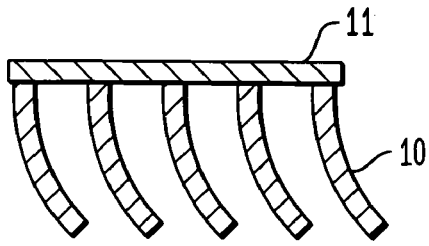
Figure 3A:
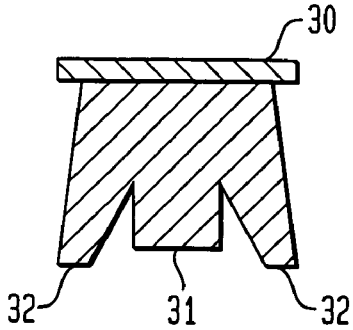
FIGS. 3A and 3B are side sectional views of a telescoping lug design according to the present invention.
Figure 4A:
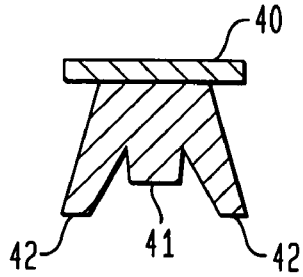
FIGS. 4A and 4B are side sectional views of an alternative telescoping lug design similar to FIG. 3.
Figure 3B:
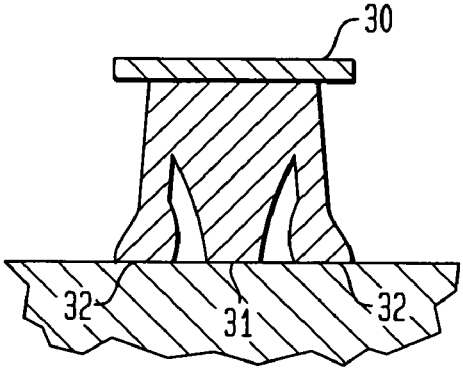
Figure 4B:
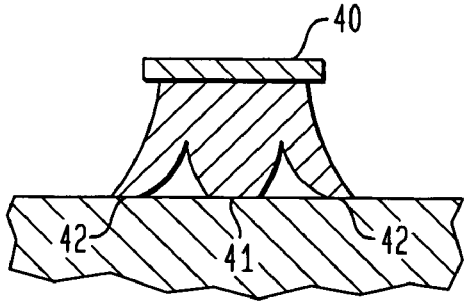
Figure 3C:
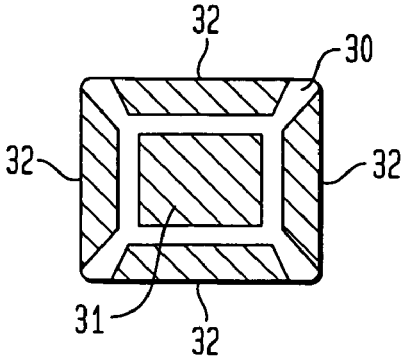
FIG. 3C is a bottom view of the lug.
Figure 4C:
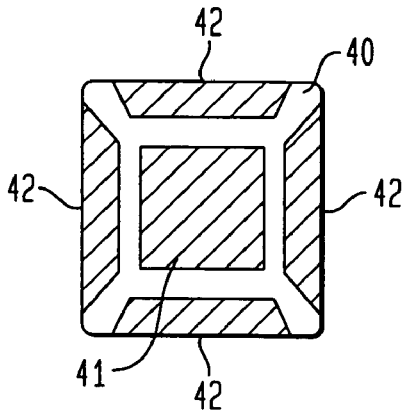
FIG. 4C is a bottom view of the lug.

As depicted in FIGS. 1A and 1B, a single lug 1 is affixed to an outsole base 2 in both the unloaded (straight) configuration (FIG. 1A), and in the loaded (bent) configuration (FIG. 1B). The loading is the result of normal and shear forces (as shown) on the lug which causes the lug to deform or bend. The stiffness of the lug presents some resistance to the shear load and absorbs (attenuates) the shear load transmitted to the outsole/ground interface.

Figure 7A:
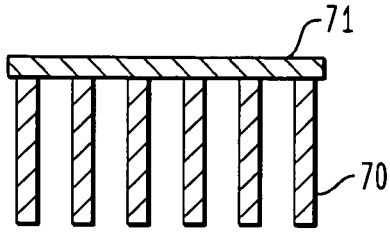
FIGS. 7A and 7B are side sectional views of a shoe outsole with multiple outsole lugs similar to FIGS. 2A and 2B, except that the lugs are shown adapting to an uneven ground surface.
Figure 7B:
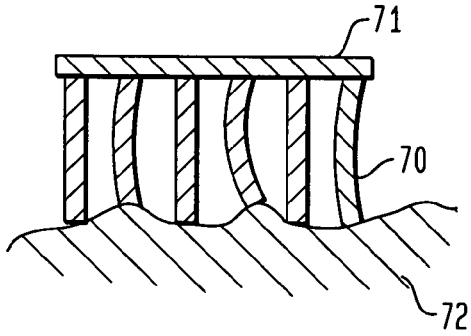

Multiple lug configurations are shown in FIGS. 2A, 2B, 7A and 7B wherein lugs 10 and 70 are shown in the loaded and unloaded condition affixed to outsole base 11 and 71. In the unloaded state, the lugs extend vertically outward, while in the loaded state, the lugs are bent and thereby increase the surface area contact of the shoe and the ground. The lugs in FIG. 7B are shown adapting to an uneven ground surface.

The lugs can be designed with various configurations, such as the telescoping design illustrated in FIGS. 3A, 3B, 3C, 4A, 4B and 4C. The center portion 31 and 41 of lug 30 and 40 is lower than the perimeter or side portion 32 and 42 of the lug. As a normal load is placed on the lug, side portions 32 and 42 deform to allow the center portion 31 and 41 to come in contact with the ground, thereby increasing the surface area contact of the lug. The normal forces exerted on the lug in FIGS. 3B and 4B cause the perimeter of the lug to depress, and the center of the lug to contact the ground as shown. Additionally, the deformation of the side perimeter of the lugs attenuates the shear force placed on the lug, and reduces the shear force that is transferred to the lug/ground surface, thus reducing the possibility of slipping.

Figure 5A:
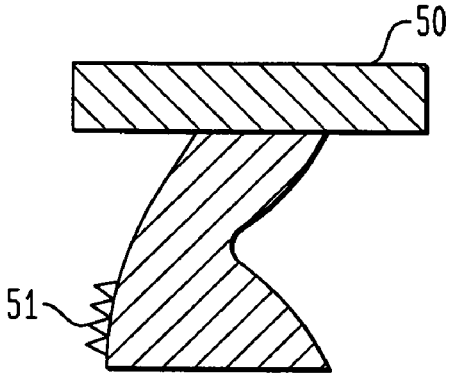
FIGS. 5A and 5B are side sectional views of a lug predisposed to bend in a forward direction when the lug is loaded vertically. The lug is shown in both an unloaded vertical position (FIG. 5A), and a bent loaded position (FIG. 5B).
Figure 6A:
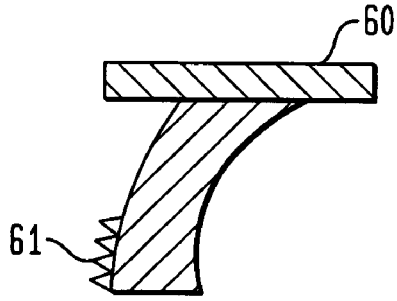
FIGS. 6A and 6B are side sectional views of a lug of the invention in a loaded (FIG. 6A) and unloaded (FIG. 6B) position. The lug is predisposed to bend in a forward direction as a result of a gradual curve in the lug.
Figure 5B:
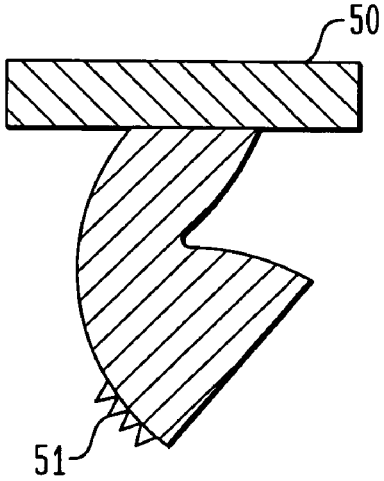
Figure 6B:
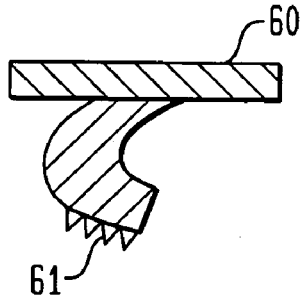

The lugs can also be predisposed to bend in a certain direction, preferably a forward direction. FIGS. 5A. 5B, 6A and 6B illustrate lug 50 ands 60 predisposed to bend in a forward direction when the lug is loaded vertically. The lugs depicted in FIGS. 5A and 6A are in the unloaded vertical position, and the bent loaded position is shown in FIGS. 5B and 6B. The bending predisposition is provided by placing a notch (or using other mechanical relief) on the forward portion of lug 50 and 60 in FIGS. 5A and 5B. The lugs are pictured with ridges 51 and 61 extending outwardly from the circumference of the lug. When loaded, the lug bends forward as shown to provide an exposed ridged sidewall surface in contact with the ground. The lug in FIGS. 6A and 6B is predisposed to bend in a forward direction as a result of a gradual curve in the lug as shown.

Figure 8:
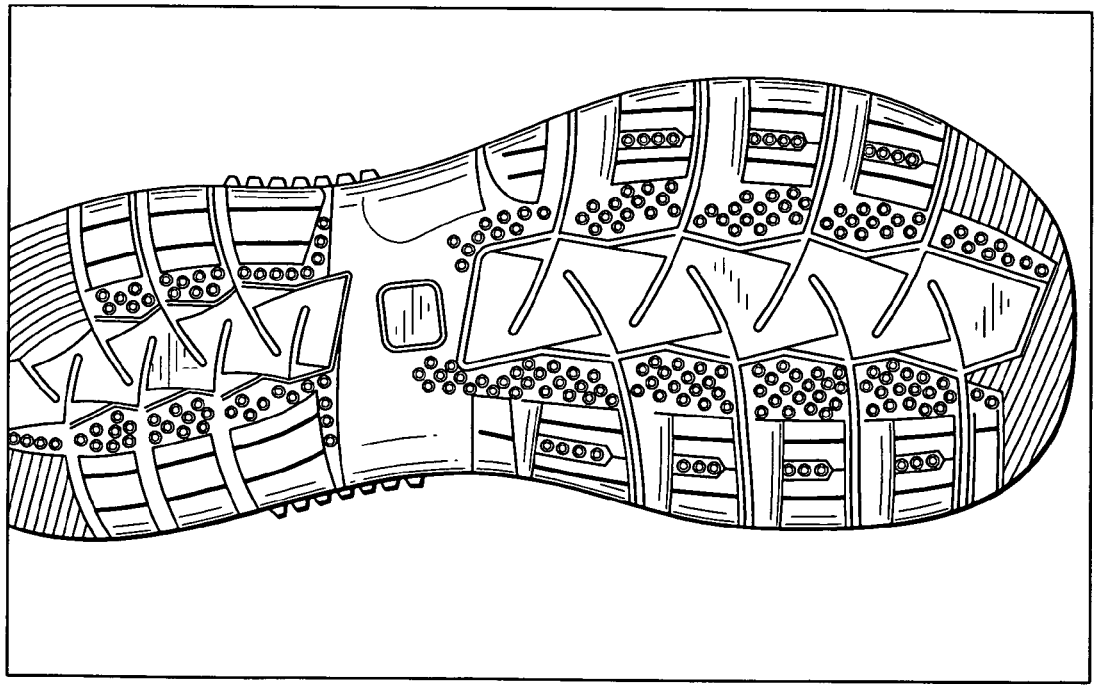
FIG. 8 is a bottom view of an outsole of the present invention showing the articulating lugs interspersed with more traditional or standard lugs commonly used on footwear.
Figure 13:
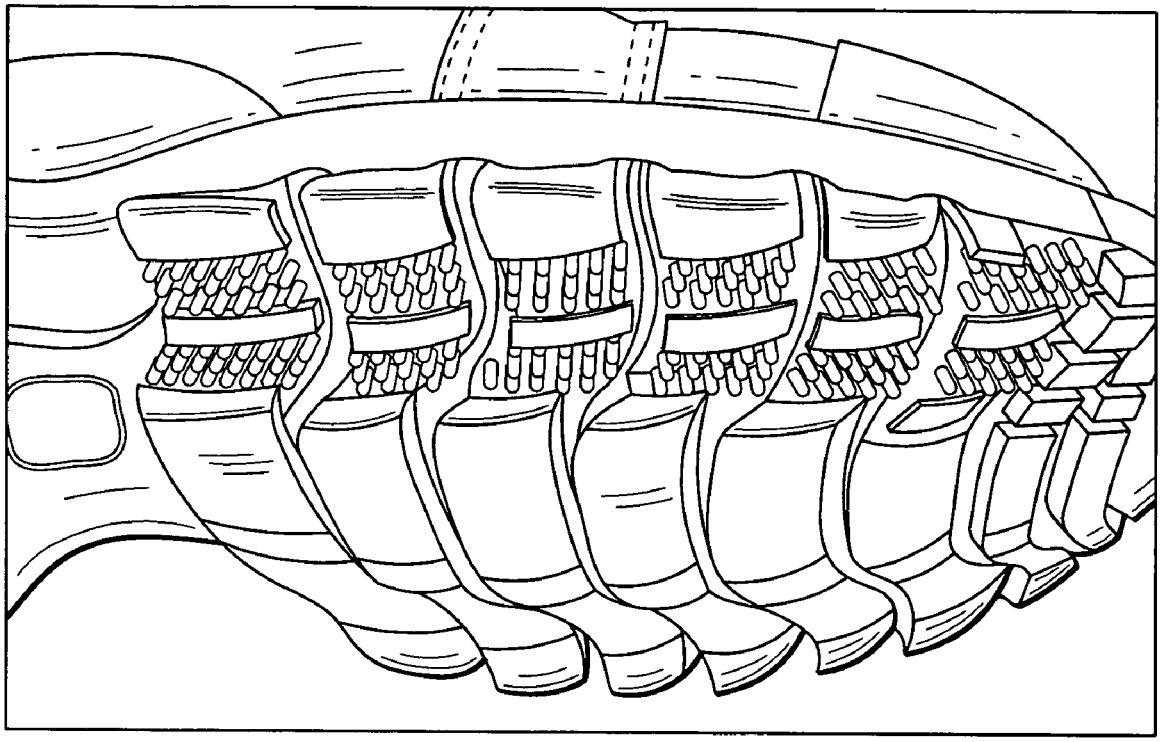
FIG. 13 is a perspective view of the toe portion of a shoe showing the articulating lugs of the present invention interspersed with standard lugs.
Figure 14:
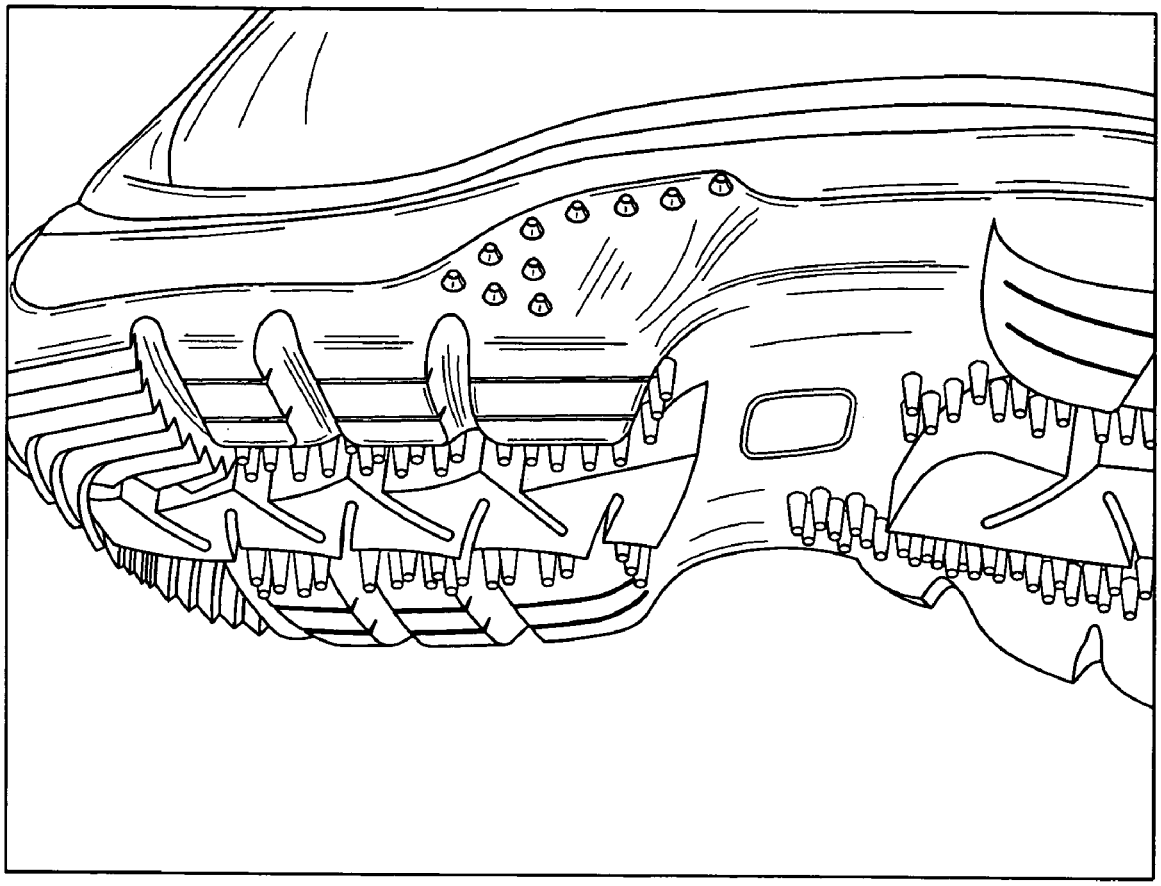
FIG. 14 is a perspective view of the heel portion of a shoe showing the articulating lugs of the present invention interspersed with standard lugs.

The articulating lugs of this invention can be interspersed with standard lugs as depicted in FIGS. 8, 13 and 14, which illustrate cylindrical articulating lugs and standard lugs combined on the same outsole. The positioning of the articulating lugs preferably coincides with specific areas on the bottom of the shoe where traction is of the utmost importance and/or would come into play during certain situations. For instance, placing articulating lugs under the ball of the foot may be advantageous. This is a high pressure area under the foot, and therefore can take advantage of the articulating lugs.

Figure 10:
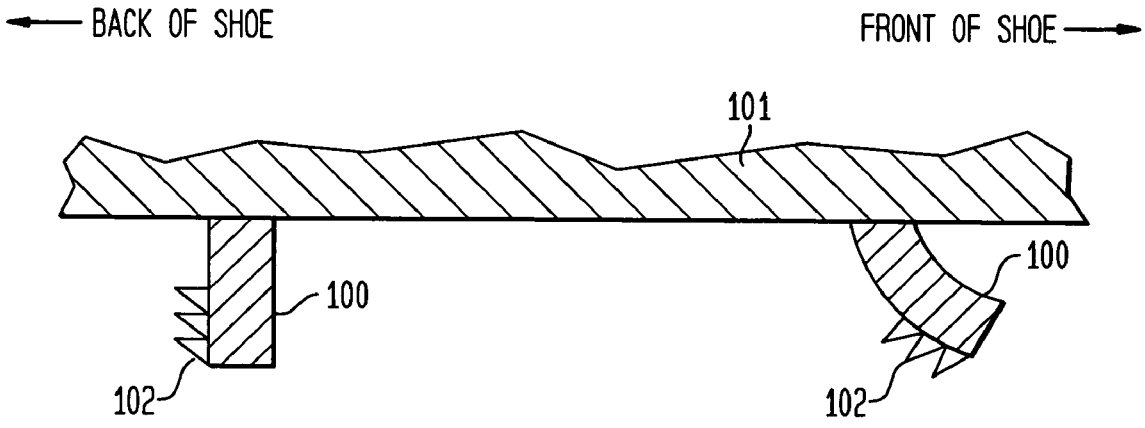
FIG. 10 is a side sectional view of yet another embodiment of a shoe lug according to the present invention in a loaded and unloaded state showing ridges or projections extending outward from the circumference of the lug.
Figure 11:
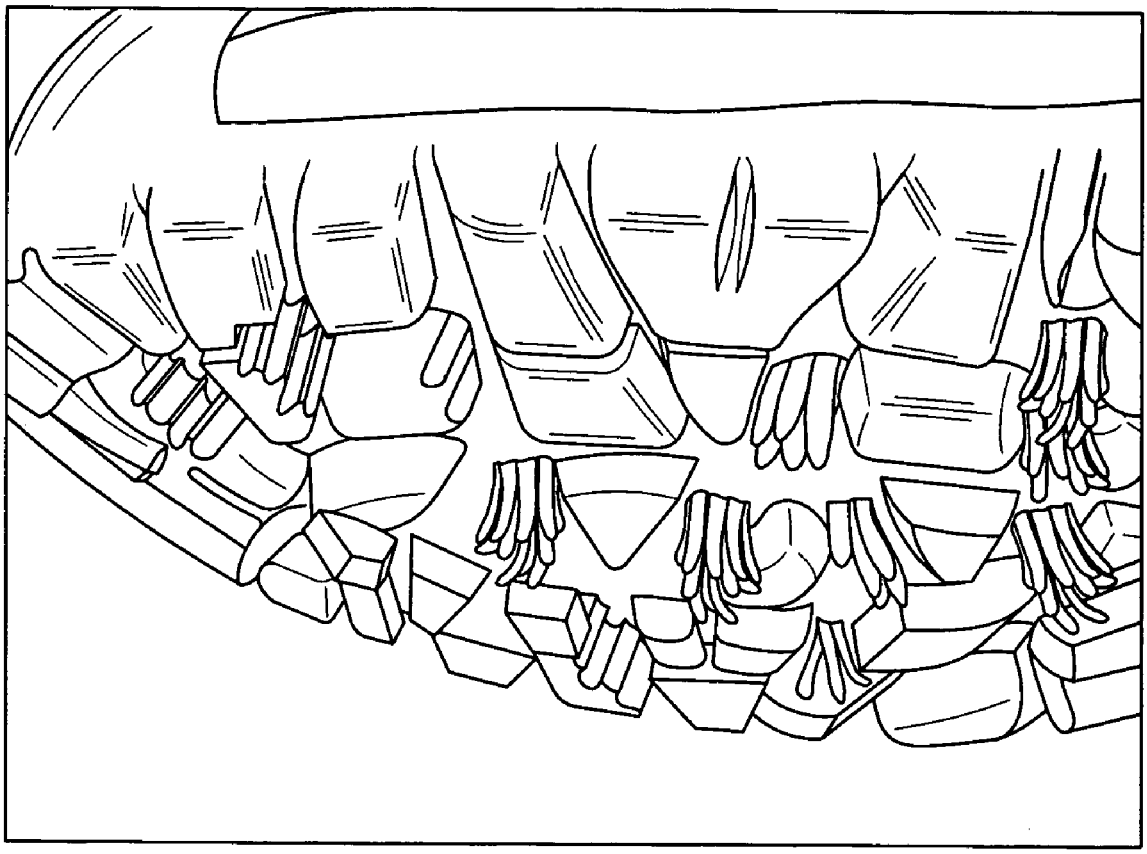
FIG. 11 is a perspective view of an outsole showing splayed or branched lugs according to the present invention interspersed with standard lugs.
Figure 12:
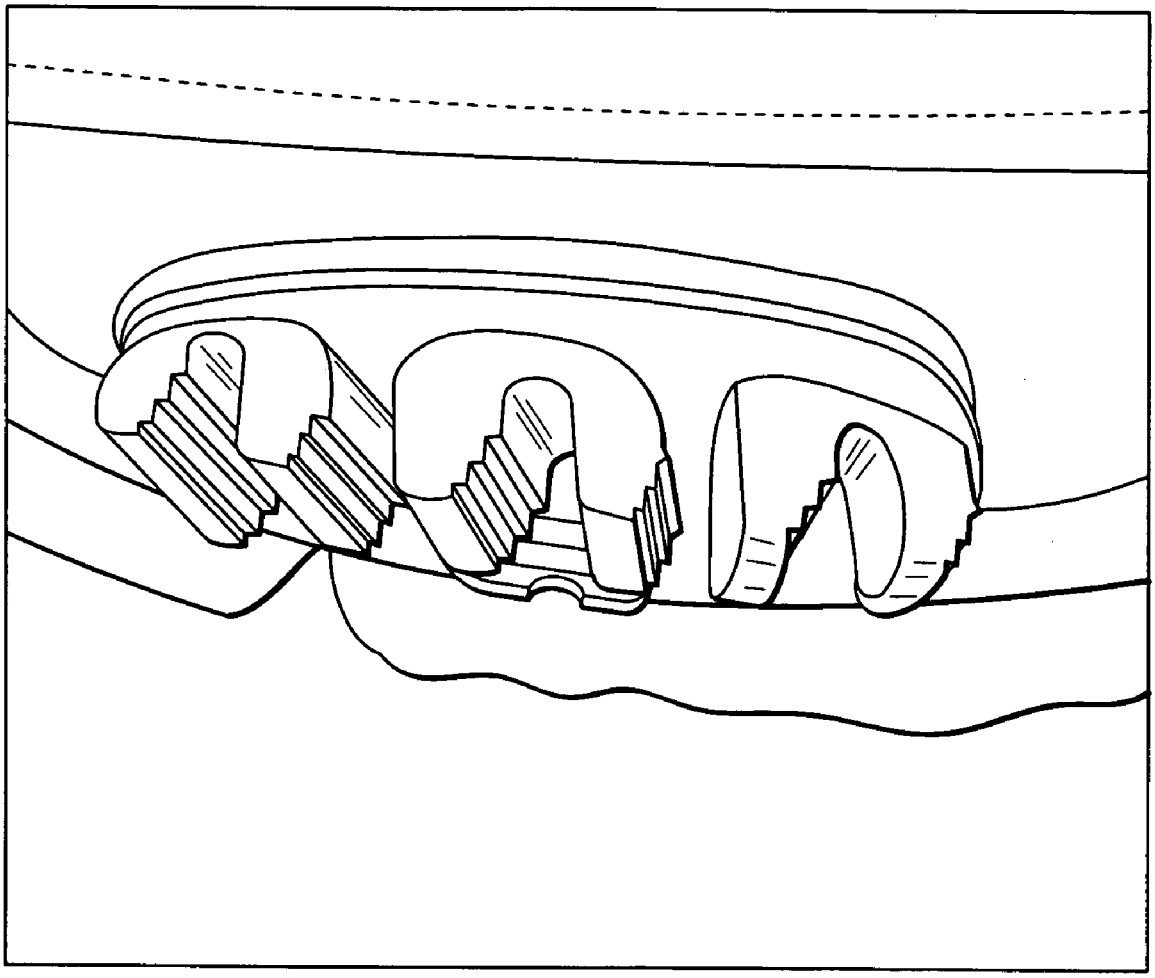
FIG. 12 is a perspective view of an outsole having sharp ridges on the rear face of the lug.

A number of geometric shapes may be adapted for use with the lugs described herein that can provide improved gripping on different surfaces. On hard packed trails, lugs with sharp ridges may dig into the trail to provide a traction benefit. This embodiment is illustrated in FIGS. 10, 11 and 12. On asphalt or cement surfaces, "nubs" that fit into the small crevasses of the surface material may create a partial interlock that would enhance traction, as shown in FIG. 8. Smooth surfaces, where there is no interlocking or the possibility of "digging in" to the surface, may require large surface area contact between the shoe and surface in order to improve traction.

In the embodiment depicted in FIG. 10, the bottom of lug 100 affixed to outsole 101 can be somewhat flat and smooth. The back side of the lug can have multiple ridge projections 102 running up the back from bottom to top. These ridge projections can be configured to interlock with a rough surfaces such as a rock, boulder, or with hard packed dirt on a trail. During a gait cycle where the shoe is loaded with normal forces, the lug articulates to expose the back side of the lug to the ground. The lug articulation, or "laying down" of the lug, allows the ridge projections to dig into the ground. Additionally, shear forces are absorbed by the mechanical stressing of the lug as it lays down. As the shoe is lifted from the ground, the lug returns to the unloaded position. The base of the lug may be designed to preferentially articulate towards the ridged side of the lug. This can be achieved in a number of ways. Reinforcing the base of the lug on the three sides without the ridges will achieve the desired result. Each lug may also, or instead, include a mechanical joint that would dictate the motion of the lug.

Figure 9:
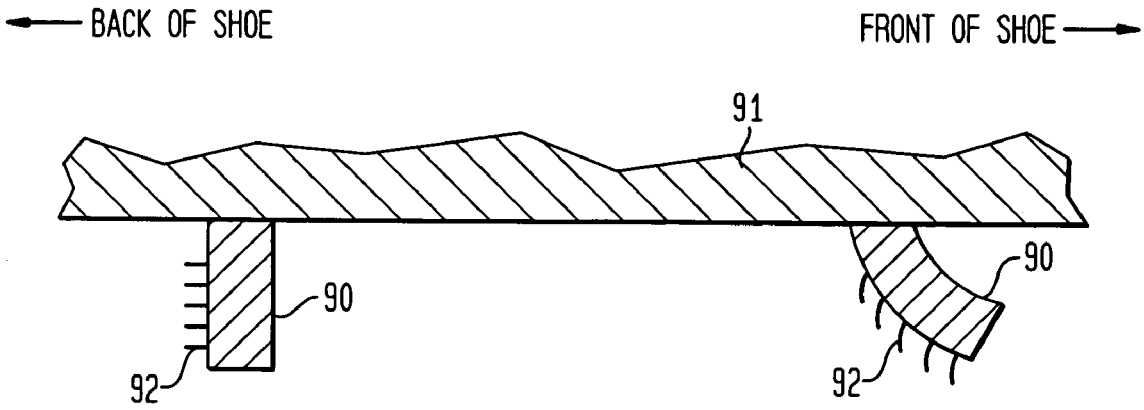
FIG. 9 is a side sectional view of another embodiment of a shoe lug according to the present invention in a loaded and unloaded state showing hair-like projections extending outward from the circumference of the lug.

As is the case in the animal world, hair-like projections 92 can be used to facilitate improvements in traction, as shown in FIG. 9. Projections 92 extend from lug 90 affixed to outsole 91. As the hair-like projections are loaded, they lay down on their sides and increase the surface area contact by allowing the long sides of the projections to come into contact with the surface. The projections can be placed on the bottom of lugs or on the side of lugs. When the projections are placed on the bottom of the lugs, the projections lay down immediately upon contact of the shoe with the surface. If the projections are placed on the sides of the lugs, the lugs must first articulate to expose the side of the lug to the surface. Once this articulation occurs, the projections will articulate to further enhance traction. The projections can move independently of one another so that they are more likely to maintain surface contact on rough surfaces.

The present invention is not limited to the lug designs and shapes specifically illustrated herein, and the invention is intended to embrace a wide variety of other designs and configurations which satisfy the criteria of improved traction over a variety of terrain. The choice of a suitable lug design for a given application will depend on several factors, including the amount of normal force at the position where the articulation occurs, and the design of the lug so that articulation will only occur in some situations and in some directions. When walking on a flat surface such as a surface that you might encounter in normal, daily activities (wood floor, vinyl, tile, sidewalk, asphalt), the pressure on the bottom shoe is more evenly distributed because most of the shoe bottom is in contact with the surface. However, on uneven surfaces there is an uneven distribution of pressure between the shoe and surface. Moreover, the forces that are exerted on uneven surfaces, such as a hiking trail, are higher than seen during normal, daily activities. This translates into higher pressures exerted between the shoe and surface. Given that the uneven surfaces will concentrate forces into smaller areas, the lugs may be designed to function as standard lugs on flat surfaces, and as articulating lugs on uneven surfaces and in sporting activities.

It is well known that a person will produce a peak ground reaction force that is 1.5 times their body weight during walking activities, and upwards of 2.5 times their body weight while running. Pressure is a function of force and surface area contact. Thus, reducing surface area contact focuses the force into a smaller area and therefore increases the pressure in that area. This occurs with no increase in total applied force. Pressure distribution occurs by spreading the total applied force across a larger area.

As compared to normal activities, hiking activities accentuate two factors resulting in increased pressure by 1) reducing total surface area contact due to the uneven surfaces, and 2) increasing total applied force. This activity creates a situation that can be taken advantage of by designing articulating lugs that articulate at higher local forces and pressures then are experienced during normal activities. This allows the lugs to act like normal lugs on flat surfaces, but to articulate when experiencing high local forces and pressures. Thus, in one embodiment, the lugs may behave like conventional lugs under certain conditions (e.g., walking, sitting), but provide the benefits of articulating lugs under other conditions (e.g., hiking, jogging, sprinting, jumping).

While this invention has been particularly shown and described with reference to certain preferred embodiments thereof, these particular embodiments are illustrative, and it will be understood by those skilled in the art that various changes in form and detail may be made therein without departing from the spirit and scope of the invention as defined by the appended claims.

What is claimed is:

1. An outsole for use with a shoe, comprising:

a first surface for securing to the shoe;

a second surface remote from the first surface; and a plurality of articulating lugs disposed on the second surface of the outsole, at least one of the plurality of articulating lugs having a telescoping configuration including a set of perimeter segments extending a first distance from the second surface and a central segment extending a second distance from the second surface, the second distance being less than the first distance, and the set of perimeter segments each having a generally quadrilateral ground contacting surface;

wherein the set of perimeter segments are deformable to enable the central segment to engage a ground surface and increase surface area contact of the at least one articulating lug; and wherein the at least one articulating lug has a generally rectangular configuration in an unloaded state.

2. The shoe outsole of claim 1 wherein the lugs are formed from the same material as the outsole, and the lugs are molded as part of the outsole.

3. The shoe outsole of claim 1 wherein the lugs are formed from a different material than the outsole, and the lugs are molded as part of the outsole.

4. The shoe outsole of claim 1 wherein the lugs are formed from a different material than the outsole, and the lugs are cemented in place to the bottom of the outsole.

5. A shoe comprising a shoe outsole and a shoe upper, said shoe outsole comprising the outsole of claim 1.

6. The shoe of claim 5 which is selected from the group consisting of a trail running shoe, a hiking shoe and a work boot.

7. The shoe outsole of claim 1 wherein the lugs are formed from a plastic material.

8. The shoe outsole of claim 7 wherein the lugs are formed from a plastic material selected from the group consisting of polyvinylchloride, polyurethane, thermoplastic urethane and ethylvinylacetate.

9. The shoe outsole of claim 1 wherein the lugs, when articulated, create a mechanical interlock with the ground surface by increasing surface area contact of at least some of the perimeter segments of the at least one articulating lug with the ground surface.

10. The shoe outsole of claim 1 wherein the mechanical action of articulation of the lugs serves to reduce or attenuate shear forces that might be applied to the ground by deforming at least some of the perimeter segments of the at least one articulating lug.

11. The outsole of claim 1, wherein the set of perimeter segments has four segments that are positioned along respective sides of the rectangular configuration.

12. The outsole of claim 1, wherein the central segment is substantially rectangular.

13. The outsole of claim 1, wherein the set of perimeter segments substantially encircle the central segment.

14. The outsole of claim 1, wherein the quadrilateral ground contacting surface of each perimeter segment is generally trapezoidal.

* * * * *